US006082969A

United States Patent [19]

Carroll et al.

[11] Patent Number: 6,082,969

[45] **Date of Patent: *Jul. 4, 2000**

[54] QUIET COMPACT RADIATOR COOLING FAN

[75] Inventors: Jim K. Carroll, Peoria; Delbert L. Kramer, Metamora, both of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/990,288

[22] Filed: Dec. 15, 1997

[51] Int. Cl.[7] ..... F04D 17/06

[52] U.S. Cl. ..... 416/192; 416/169 A; 416/223 R

[58] Field of Search ..... 416/169 A, 188, 416/189, 192, 223 R, 238

[56] References Cited

U.S. PATENT DOCUMENTS

| | | | |
|---|---|---|---|
| 3,727,593 | 4/1973 | Enke | 123/41.12 |
| 4,061,188 | 12/1977 | Beck | 165/122 |
| 4,173,995 | 11/1979 | Beck | 165/51 |
| 4,289,450 | 9/1981 | Kling | 416/192 |
| 4,357,914 | 11/1982 | Hauser . | |
| 4,358,245 | 11/1982 | Gray . | |
| 4,900,229 | 2/1990 | Brackett et al. . | |
| 4,981,461 | 1/1991 | Henderson . | |
| 5,000,660 | 3/1991 | Van Houten et al. . | |
| 5,183,382 | 2/1993 | Carroll | 415/173.6 |
| 5,193,608 | 3/1993 | Sekine et al. | 165/41 |
| 5,273,400 | 12/1993 | Amr . | |
| 5,297,931 | 3/1994 | Yapp et al. . | |
| 5,513,951 | 5/1996 | Komoda et al. . | |
| 5,520,513 | 5/1996 | Kuroki et al. | 415/223 |
| 5,616,004 | 4/1997 | Alizadeh | 416/238 |
| 5,769,607 | 6/1998 | Neely et al. | 416/189 |
| 5,810,557 | 9/1998 | Akinkuotu et al. | 415/206 |

FOREIGN PATENT DOCUMENTS

| | | |
|---|---|---|
| 0066158 | 12/1982 | European Pat. Off. . |
| 0187940 | 7/1986 | European Pat. Off. . |
| 2757092 | 7/1978 | Germany . |
| 3128654 | 8/1982 | Germany . |
| 4127134 | 2/1993 | Germany . |
| WO9706369 | 2/1997 | WIPO . |

OTHER PUBLICATIONS

Jorgensen, Robert., "Fans", Chapter 14.5, Avallone et al., Mark's Standard Handbook for Mechanical Engineers, 9th Edition, McGraw–Hill, Inc., New York, 1987, pp. 14–(48–9), Dec. 1987.

*Primary Examiner*—Edward K. Look
*Assistant Examiner*—Matthew T. Shanley
*Attorney, Agent, or Firm*—Fred J. Baehr; Jeffrey L. Myers

[57] ABSTRACT

A quiet compact radiator cooling fan having a hub portion, which extends radially outwardly and axially from its inlet to its outlet end, a shroud portion, which extends radially inwardly and axially adjacent the inlet end and radially outwardly and axially adjacent its outlet end forming a converging annular opening and a plurality of airfoil shaped, forward sweep blades disposed between the hub and shroud which cooperate with the hub and shroud to produce a mixed flow radiator fan which has improved blade loading and aeroacoustic performance producing a quiet and efficient cooling fan for off the road vehicles.

13 Claims, 4 Drawing Sheets

Fig. - 5 -

| HUB | | | | SHROUD | | | |
|---|---|---|---|---|---|---|---|
| X1 | R1 | X2 | R2 | X1 | R1 | X2 | R2 |
| -30 | 0 | -12 | 0 | -30 | 365.1 | -25 | 365.1 |
| -30 | 87.44 | -12 | 96.85 | -30 | 338.74 | -25 | 341.46 |
| -29.85 | 92.19 | 12.02 | 144.14 | -28.64 | 333.72 | -21.63 | 335.95 |
| -29.39 | 96.93 | 114.7 | 255.2 | -25.22 | 329.62 | -10.86 | 331.22 |
| -28.62 | 101.64 | | | -20.98 | 326.69 | 0.01 | 329.75 |
| -27.57 | 106.31 | | | -16.75 | 324.74 | 10.47 | 330.82 |
| -26.22 | 110.93 | | | -12.85 | 323.47 | 16.68 | 332.88 |
| -24.6 | 115.47 | | | -9.32 | 322.66 | 107.27 | 370.9 |
| -22.71 | 119.93 | | | -6.08 | 322.15 | | |
| -20.58 | 124.31 | | | -3.05 | 321.86 | | |
| -18.2 | 128.56 | | | -0.14 | 321.75 | | |
| -15.62 | 132.75 | | | 2.75 | 321.78 | | |
| -12.82 | 136.8 | | | 5.71 | 321.98 | | |
| -9.85 | 140.73 | | | 8.83 | 322.37 | | |
| -6.71 | 144.53 | | | 12.21 | 323.01 | | |
| -3.42 | 148.21 | | | 15.92 | 324.03 | | |
| 0 | 151.75 | | | 20 | 325.6 | | |
| 109.1 | 260.8 | | | 109.3 | 366.3 | | |

Fig. - 6 -

| PRESSURE SURFACE | | SUCTIONS SURFACE | |
|---|---|---|---|
| X | Y | X | Y |
| 13.12 | 18.69 | -125.68 | 101.66 |
| -13.92 | 31.17 | -121.07 | 95.39 |
| -28.04 | 38.46 | -.107.13 | 80.81 |
| -46.05 | 47.8 | -86.22 | 64.02 |
| -83.53 | 69.61 | -66.78 | 51.36 |
| -99.91 | 80.93 | -47.37 | 40.55 |
| -109.77 | 88.62 | -21.09 | 28.06 |
| -125.39 | 102.14 | 5.04 | 18.82 |
| -125 | 102.21 | 11.83 | 17.31 |

QUIET COMPACT RADIATOR COOLING FAN

TECHNICAL FIELD

The invention relates to a radiator cooling fan for an internal combustion engine and more particularly to a mixed flow radiator cooling fan which is quiet and compact.

BACKGROUND ART

In motor vehicle applications, particularly off the road vehicles, a fan situated behind a radiator draws a large quantity of air through the radiator, as the vehicle speed is relatively low. Low noise level is also a requirement. Therefore quieter compact fans are needed to reduce cooling system size and still meet the sound and cooling requirements of off road motor vehicles.

U.S. Pat. No. 4,358,245 describes a low noise, axial flow fan particularly suited for use in a turbulent airflow such as the flow existing in an automobile radiator. The fan has a shroud secured to the outer end of the fan blades. The blades are forwardly skewed and have an increasing blade angle as the blade extends outwardly. The shroud forms a converging nozzle. Each blade has an airfoil cross-section and the entire fan is formed as a single injection molded plastic integral structure.

DISCLOSURE OF THE INVENTION

Among the objects of the invention may be noted the provision of a quiet, compact and efficient radiator cooling fan.

In general, a radiator-cooling fan for an internal combustion engine, when made in accordance with this invention comprises a hub portion and a shroud portion having an inlet end and an outlet end. The hub portion has radially outwardly extending portion adjacent the inlet end and then a portion which progresses axially and radially outwardly to the outlet end. The shroud portion has a radially inwardly extending portion adjacent the inlet end then a portion which progresses radially inwardly and axially connected to a portion which progresses radially outwardly and axially to the outlet end. A plurality of forward sweep, airfoil shaped blades extend from the hub to the shroud to form a mixed flow fan with improved blade loading and aeroacoustic performance.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

FIG. 5 is a table giving the coordinates of the hub and shroud surfaces relative to a central axis shown in FIG. 1; and FIG. 6 is a table giving the coordinates of the outer surface of the cross section of the blade shown in FIG. 4.

BEST MODE FOR CARRYING OUT THE INVENTION

Figure 1:
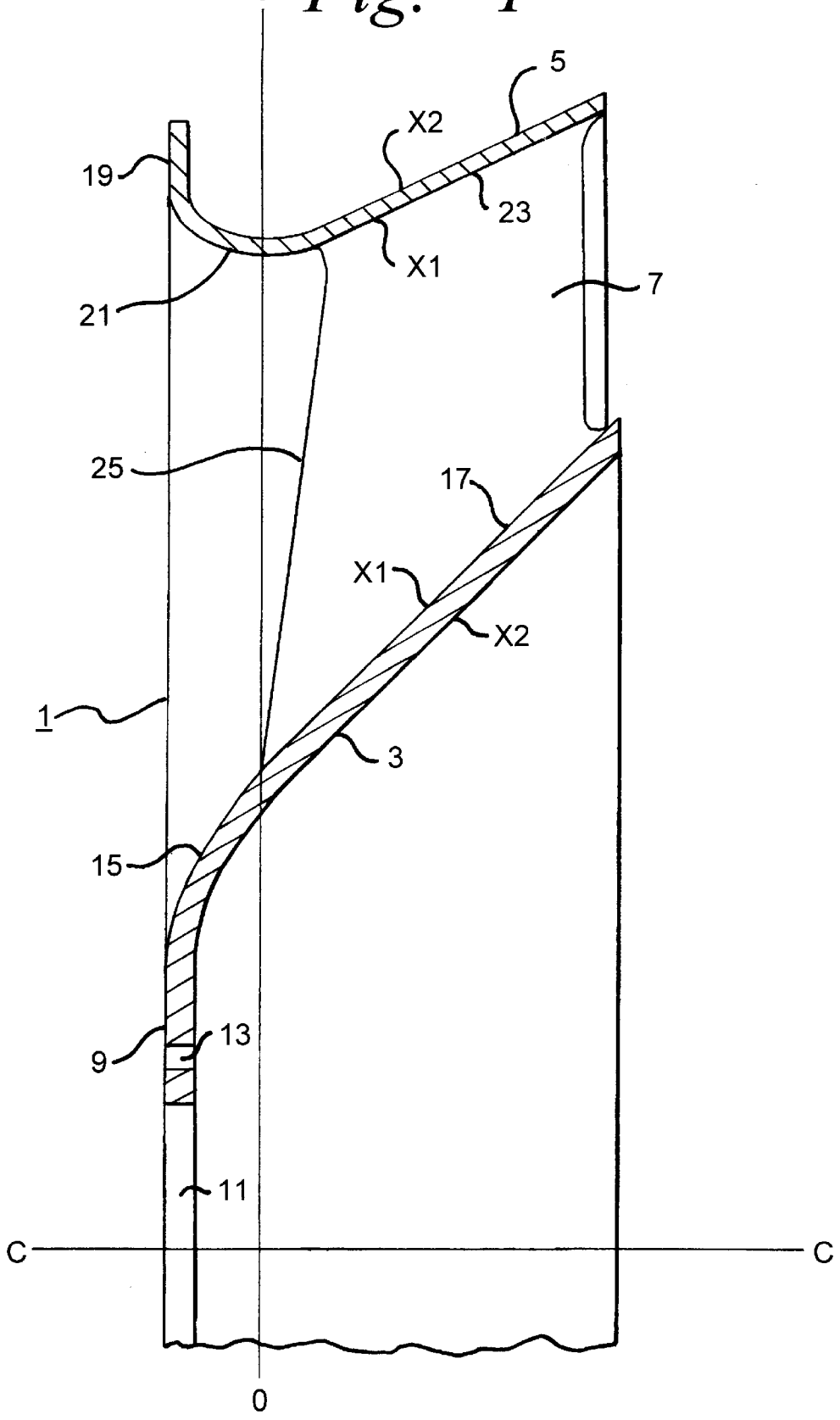
FIG. 1 is a partial sectional view of a compact, quiet fan made in accordance with this invention.

Referring now to the drawings in detail and in particular to FIG. 1, there is shown a portion of a compact, quiet mixed flow fan 1 comprising a hub portion 3, a shroud portion 5 and a plurality of airfoil shaped blades 7.

The hub portion 3 starting at an inlet end and ending at an outlet end comprises a radially outwardly extending portion 9 having a central bore 11 and a plurality of bolt holes 13 disposed in a circular array out board of the bore 11. A curved portion 15 provides a smooth transition between the radially outwardly extending portion 9 and an axially and radially outward extending frustoconical portion 17 having an inner surface, which if extended to its apex would form an included angle generally about 90 degrees. Thus forming a hub portion 3 that progresses axially and radially outwardly from its inlet end to its outlet end.

The shroud portion 5 starting at its inlet end and ending at its outlet end comprises a radially inwardly extending portion 19. A trumpet shaped portion 21 extending radially and axially inward to form a smooth transition between the radially inwardly extending portion 19 and an axially and radially outward extending frustoconical portion 23. The frustoconical portion having an inner surface, which if extended to its apex would form an included angle generally about 50 degrees. The hub portion 3 and shroud portion 5 cooperating to form a converging annular opening which directs the flow from the fan generally axially and radially outward at an angle substantially less than 90 degrees with respect to the axis of rotation the fan 1.

The lines CC and OO are references for lying out the surfaces on the hub and shroud portions 3 and 5 utilizing the table in FIG. 5. The hub and shroud surfaces, which contact the blades 7 are indicated as X1 and the hub and shroud surfaces, which do not contact the blades 7 are indicated as X2. R1 and R2 are the radii in millimeters from the centerline CC to the coordinates X1 and X2, respectively. In the table in FIG. 5 negative coordinates X1 and X2 are in millimeters to the left of line OO which represents a plane perpendicular to the centerline CC and positive coordinates X1 and X2 are in millimeters to the right of line or plane OO. The table in FIG. 5 is utilized to provide the coordinates (X1, R1) and (X2, R2), which define a plurality of circles that are connected to form the smooth continuous surfaces of revolution which form the hub and shroud portions 3 and 5 of the fan 1.

Figure 2:
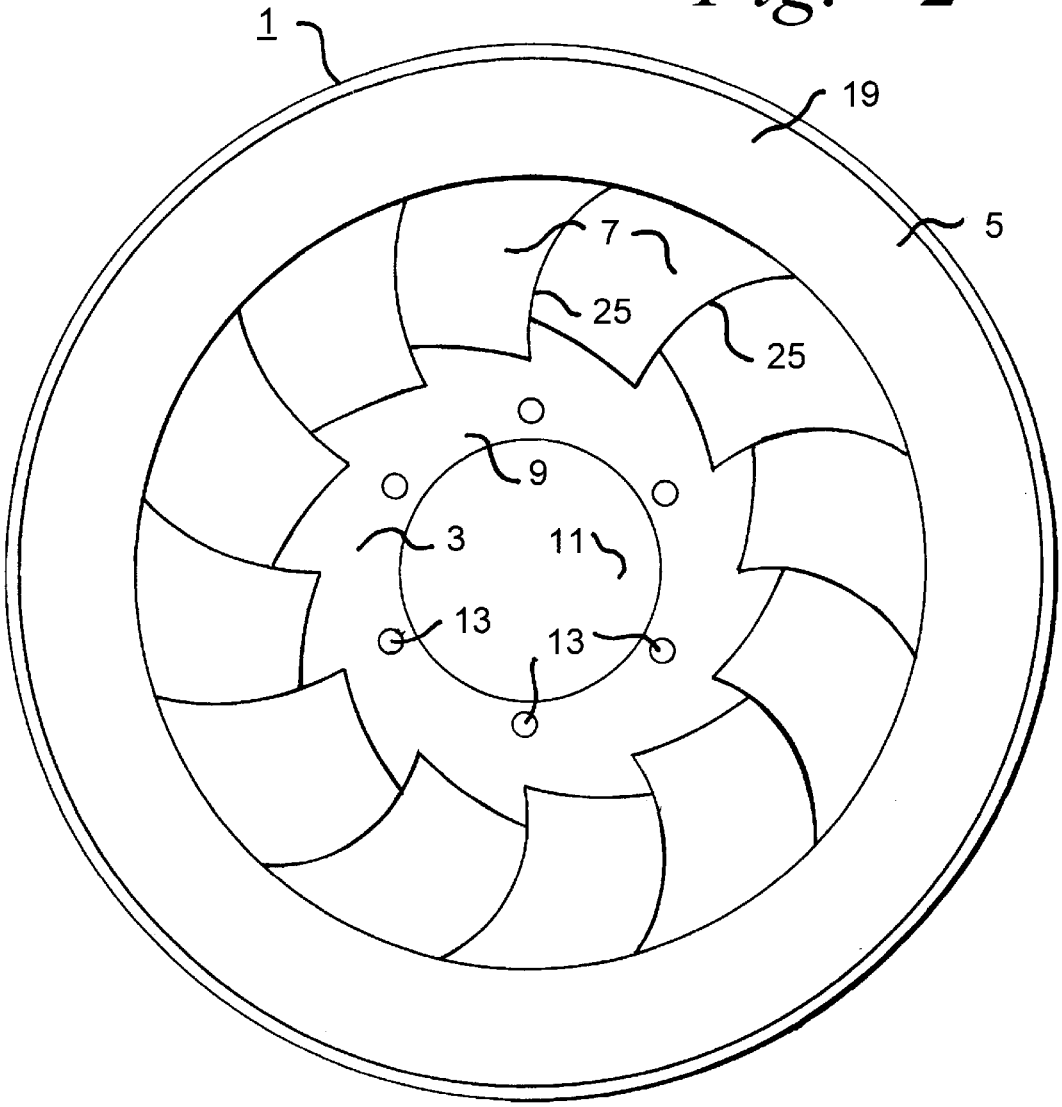
FIG. 2 is a front elevational view of the fan.

As shown in FIG. 2, the plurality of blades 7 are disposed in a circular array and have a leading edge 25 that is swept forward adjacent the shroud. The blades 7 are formed integral with the hub 3 and shroud 5.

Figure 3:
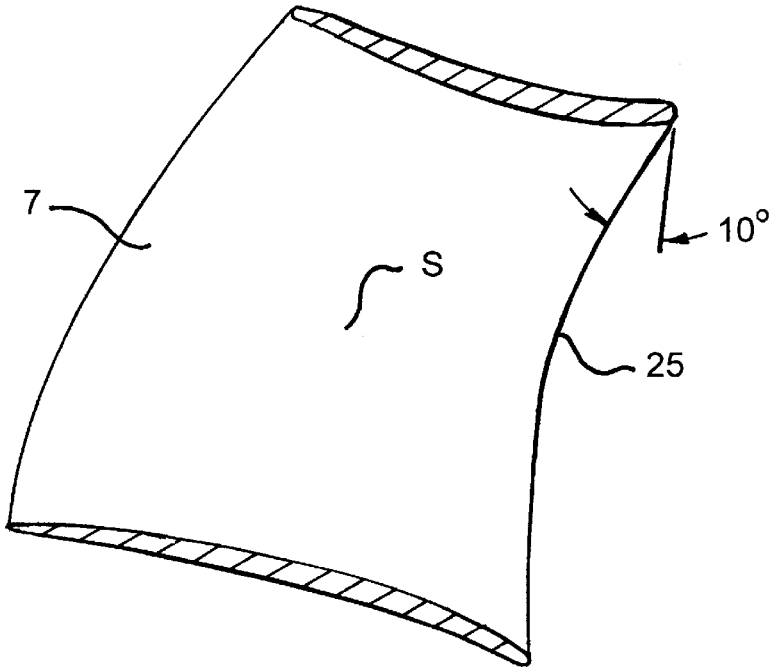
FIG. 3 is partial view of a blade for the fan showing the forward sweep of the blade relative to a radial, axial plane.

FIG. 3 shows the forward sweep of the leading edge 25 is generally in the range of about 10 degrees and generally extends down from the shroud 5 about 20% of the height of the blade 7. The inner 80% of the leading edge 25 may sweep slightly backward with respect to a radial line.

Figure 4:
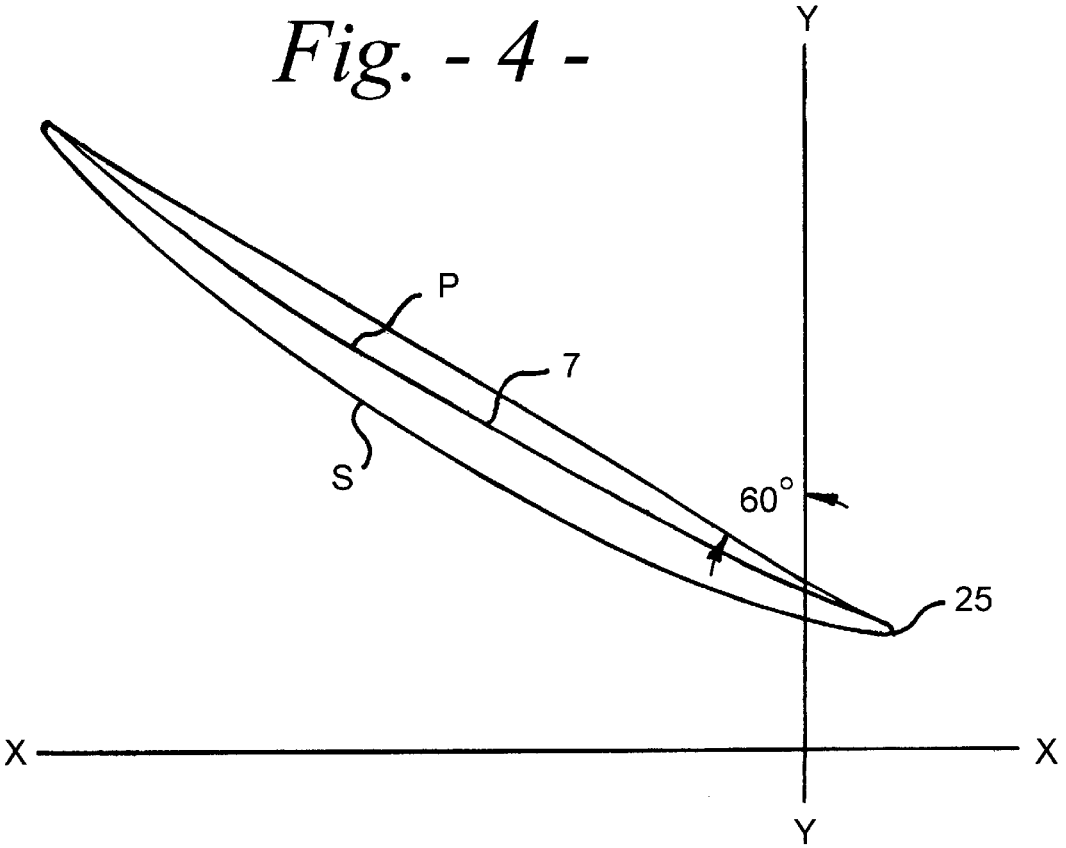
FIG. 4 shows a typical cross section of the blades.

FIG. 4 shows a typical airfoil cross section of the blades 7. The lines XX and YY are axes for laying out the airfoil surfaces utilizing the table in FIG. 6. P indicates the pressure surface, which is concave and S indicates the Suction surface, which is convex. Positive X numbers are coordinates of the airfoil surface in millimeters to the right of the line YY and negative X numbers are coordinates in millimeters to the left of the line YY. Positive Y numbers are coordinates in millimeters above Line XX. The pitch of the blades 7 is generally the same from the hub 3 to the shroud 5 and is generally about 60 degrees with respect to the axis of rotation of the fan.

The shape of the hub 3 and shroud 5 cooperates with the airfoil shaped, forward swept blades 7 to maintain uniform blade loading and superior aerodynamic performance with no separation of the air flow over the entire blade span while reducing ingestion noise to produce a quiet compact efficient radiator fan 1.

While the preferred embodiments described herein set forth the best mode to practice this invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The quiet compact mixed flow fan with forward swept blades, herein before described, advantageously produces a specific noise level generally about 30 decibels providing a quiet fan, which is both a cost and space effective solution to cooling system performance of off the road vehicles. Manufacturing the fan as an aluminum casting provides a cost effective fan that is durable and has good damping characteristics.

What is claimed is:

1. A radiator cooling fan for an internal combustion engine comprising an inlet end and an outlet end, a hub portion which progresses radially outwardly and axially from adjacent the inlet end to the outlet end, a shroud portion which extends radially inwardly and axially adjacent the inlet end and then radially outwardly and axially to the outlet end, the hub and shroud portions progressing and extending from the same plane on the inlet end, and a plurality of airfoil shaped blades extending from the hub to the shroud portions and being made integral therewith, the hub and shroud portions cooperating to form a converging annular opening, edges of the blades adjacent the inlet end of the fan being leading edges and a portion of the leading edge adjacent the shroud portion being inclined in the direction of rotation of the fan to produce blades with forward sweep to form a mixed flow fan with improved blade loading and aeroacoustic performance.

2. The radiator cooling fan as set forth in claim 1, wherein the hub portion has a portion that extends radially outwardly adjacent the inlet end and a curved portion forming a smooth transition between the radially outwardly extending portion and the portion extending radially and axially outwardly.

3. The radiator cooling fan as set forth in claim 2, wherein the shroud portion has a portion that extends radially inwardly adjacent the inlet end and joins the portion which extends radially inwardly and axially.

4. The radiator cooling fan as set forth in claim 3, wherein the shroud portion that extends radially inwardly and axially, is shaped like the end of a trumpet, forming a smooth transition between the portion of the shroud extending radially inwardly and a portion extending axially and radially outwardly.

5. The radiator cooling fan as set forth in claim 4, wherein the shroud and hub portions that extend radially outward and axially are frustoconical portions which increase in diameter toward the fan outlet.

6. The radiator cooling fan as set forth in claim 5, wherein the frustoconical portion of the hub if extended to its apex has an included angle generally about 90 degrees and the frustoconical portion of the shroud if extend to its apex has an included angle generally about 50 degrees to form a converging annular opening.

7. The radiator cooling fan as set forth in claim 1, wherein the leading edge of the blades is swept forward in the direction of rotation about 10 degrees measured from the juncture of the leading edge with the shroud to a radial line extending from the juncture of the leading edge with the shroud.

8. The radiator cooling fan as set forth in claim 7, wherein the forward sweep portion of the leading edge of the blade extends from the shroud about 20% of the height of the blade.

9. The radiator cooling fan as set forth in claim 1, wherein an outer surface of the hub is defined by a plurality of coordinates X1, R1 which indicate a distance X1 from a plane perpendicular to a centerline and a radius R1 from the centerline, the coordinates define a plurality of circles, which are connected to form a smooth continuous surface.

10. The radiator cooling fan as set forth in claim 9, wherein an inner surface of the shroud is defined by a plurality of coordinates (X1, R1) which indicate a distance X1 from a plane perpendicular to a centerline and a radius R1 from the centerline, the coordinates define a plurality of circles, which are connected to form a smooth continuous surface.

11. The radiator cooling fan as set forth in claim 1, wherein the airfoil shape is defined by a plurality of (X, Y) coordinates which indicate the distance from X and Y axes.

12. The radiator cooling fan as set forth in claim 1, wherein the blades have a pitch which is generally the same from the hub to the shroud.

13. The radiator cooling fan as set forth in claim 12, wherein the pitch of the blades is generally about 60 degrees with respect to an axis of rotation of the fan.

* * * * *